US005183544A

United States Patent [19]

Weber et al.

[11] Patent Number: 5,183,544

[45] Date of Patent: Feb. 2, 1993

[54] APPARATUS FOR ELECTROWINNING OF METAL FROM A WASTE METAL MATERIAL

[75] Inventors: Joseph R. Weber; Ronald E. Bilak, both of Rochester, N.Y.

[73] Assignee: Xerox Corporation, Stamford, Conn.

[21] Appl. No.: 635,313

[22] Filed: Jan. 3, 1991

[51] Int. Cl.[5] ..... C25C 7/00

[52] U.S. Cl. ..... 204/252; 204/260; 204/261; 204/263; 204/264; 204/265; 204/272; 204/273; 204/276; 204/277; 204/212

[58] Field of Search ..... 204/252, 260, 261, 263, 204/264, 265, 272, 273, 275-277, 212

[56] References Cited

U.S. PATENT DOCUMENTS 4,406,753 9/1983 Blake et al. ..... 204/272

*Primary Examiner*—John Niebling
*Assistant Examiner*—David G. Ryser
*Attorney, Agent, or Firm*—Finnegan, Henderson, Farabow, Garrett & Dunner

[57] ABSTRACT

An apparatus and method for electrowinning metal from particulate waste metal material is provided whereby waste metal material is mixed with an electrolyte to form a suspension. The suspension is separated into portions. A first portion enters the anodic compartment and a second portion is filtered and enters the cathodic compartment where metal is electrowon onto a rotating cathode.

9 Claims, 1 Drawing Sheet

APPARATUS FOR ELECTROWINNING OF METAL FROM A WASTE METAL MATERIAL

BACKGROUND OF THE INVENTION

The present invention relates to an apparatus and method for the recovery or winning of a metal from a waste metal material, and more particularly, to a process for the electrowinning of a metal, e.g. nickel, from a metal hydroxide press cake.

In the conventional electrowinning of metals, the metal to be electrowon is first dissolved by chemical means in the electrolytic cell containing an insoluble anode. Conventional electrowinning processes employ cells containing planar or grid-type anodes and planar cathodes. The metal ions in the electrolyte are discharged at the cathode surface by passage of a direct electric current, to form a deposit of relatively pure metal, while negative ions, such as hydroxyl or sulfate ions, are discharged at the anode and then reform with the release of molecular oxygen bubbles. The electrolyte usually consists of an aqueous solution of one or more salts of the metal which is in solution so as to promote electrodeposition of the metal on the cathode in such form and purity as is desired.

Conventional electrowinning cells usually require large cathode surface areas. U.S. Pat. No. 4,129,494 to Norman discloses the use of about 50 or more cathode sheets or plates with a total active surface area of greater than 1000 square feet. This large surface area is exceedingly costly. Not only do the large number of cathodes add to the capital costs, but the often desirable high current densities lead to high operating costs and difficult design problems in obtaining adequate current. Current density is defined as the ratio of current in amperes to the area of cathode. Thus, the larger the cathode surface area is, the greater the current must be.

Additionally, the requirement of first dissolving the metal in an acidic solution is costly and time consuming since the resulting solution oftentimes must be treated to remove the excess acid. Then, once the solution undergoes electrowinning, some mechanism is required to neutralize or recover the regenerated acid.

These and other limitations and disadvantages of the prior art are overcome by the present invention which eliminates the necessity for dissolving the metal to be electrowon, and the prior art large surface area requirements.

SUMMARY OF THE INVENTION

The present invention overcomes the above-described problems and disadvantages encountered in the prior art, as well as has additional advantages that will be discussed hereinbelow.

The present invention has provided an economically feasible apparatus and method for converting what would otherwise be an environmentally unsound waste product into a usable and/or salable product. In so doing, there has been provided an apparatus and method of electrowinning metal from a waste metal material which have decreased capital and operating costs as compared to the prior art methods and apparatuses by electrowinning a metal from a waste metal material at a while employing a rotating cathode. The decreased cost is due in part to the greatly reduced surface area required for the cathodes and attributable to the high metal concentration and the rotating cathode of the present invention.

A further objective of this invention is an electrowinning process which provides quality metal output.

To achieve the foregoing and additional objects, an apparatus for electrowinning a metal from a waste metal material is provided, comprising a vessel including means for mixing said waste metal material with an electrolyte to form a suspension, an electrolytic cell in fluid connection with said vessel, the electrolytic cell comprising a cathodic compartment having a rotating cathode, an anodic compartment adjacent to the cathodic compartment and a means for separating disposed between the cathodic and anodic compartments. The apparatus further comprises a means for moving a flow of the suspension from the vessel to the electrolytic cell, and a filter means located between the vessel and the electrolytic cell.

In a preferred embodiment, the means for moving a flow of suspension comprises means for splitting the flow into a first portion and a second portion, means for passing said first portion to the anodic compartment, and means for passing the second portion through the filter means and to the cathodic compartment.

In a further preferred embodiment, the vessel comprises means for mixing said waste metal material with an electrolyte to form a pre-mix thereof to form a suspension.

Also in accordance with the present invention, as embodied and broadly described herein is a method for electrowinning a metal from a particulate waste metal material in an electrolytic cell comprising an anodic compartment and a cathodic compartment having a rotating cathode, comprising the steps of preparing an electrolyte by dissolving particulate waste metal material in a strong mineral acid, forming a suspension of a waste metal material in the electrolyte, flowing a first portion of the suspension into the anodic compartment of the cell, separating particulates having a size of from about 1 to about 5 μm from a second portion of the suspension and flowing the second portion of the suspension into cathodic compartment, electrowinning metal onto the rotating cathode while maintaining the conditions of a cathode current density of 11 to 33 $A/dm^2$, a metal ion concentration of 90 to 110 g/L, an electrolyte pH of about 2.5 to about 3. 6 in the anodic compartment, and a temperature of about 55° C. to about 65° C.

Preferably, the method further comprises upwardly flowing an oxygen-containing gas supply in the cathodic compartment. It is preferred that the gas is air.

In a particularly preferred embodiment, the rotating cathode has a surface velocity of 60 to 300 feet per minute.

In a further preferred embodiment a relatively high flow rate is maintained in the anodic compartment while a relatively low flow rate is maintained in the cathodic compartment.

In an additionally preferred embodiment a pH differential is maintained in the cathodic and anodic compartments.

Additional objects and advantages of the invention will appear more fully from the description which follows, and in part will be apparent from the description, or may be learned by practice of the invention. The objects and advantages of the invention may be realized and obtained by means of the mechanisms and combinations pointed out in the appended claims.

The accompanying drawings, which are incorporated in and constitute a part of the specification, illustrate one embodiment of the invention and, together with the description, serve to explain the principles of the present invention.

DESCRIPTION OF THE PREFERRED EMBODIMENTS

In describing in more detail various preferred embodiments of the present invention, reference will be made to the accompanying drawing.

Figure 1:
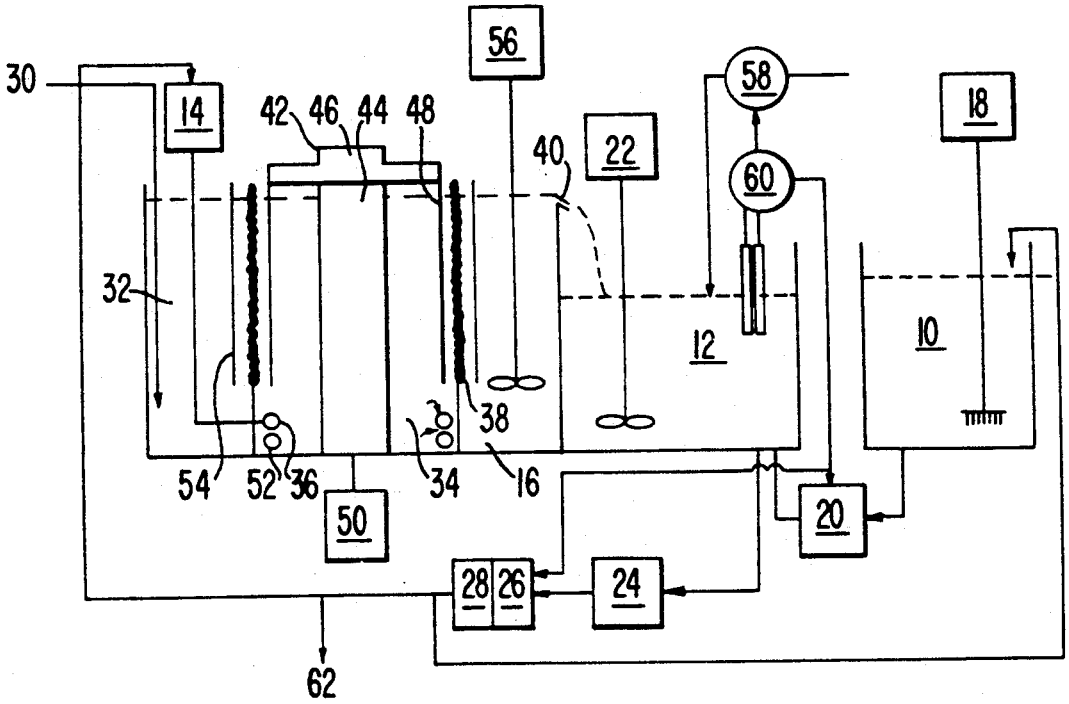
FIG. 1 is a schematic side view of the pilot plant which is functionally equivalent to the laboratory cell in which the test runs discussed herein were conducted.

Referring now to FIG. 1, there is shown pre-mix tank 10, sump tank 12, filter 14 and electrolytic cell, generally 16. Sump tank 12, filter 14 and electrolytic cell 16, together with the fluid connections, are referred to generally as the electrowinning module.

In pre-mix tank 10, a waste metal material is mixed with an electrolyte to form a pre-mix thereof. In the preferred embodiment shown, pre-mix tank 10 is provided with a high shear mixer 18.

From pre-mix tank 10, the pre-mix is transported by pump 20 to sump tank 12 which contains an electrolyte which is preferably the same electrolyte as used in pre-mix tank 10. In sump tank 12, the pre-mix suspension is added to the total volume of anode electrolyte to form a diluted suspension. Sump tank 12 in combination with anode tank 32 contains a volume of electrolyte sufficient to prevent a rapid change in the concentration or pH of the electrolyte. In the embodiment shown, sump tank 12 is provided with mixer 22.

From sump tank 12, a flow of suspension is moved by pump 24 through heat exchangers 26 and 28. The flow of suspension is then split at 30 with a first portion, preferably up to about 97% of the flow, passing into anodic compartment 32 and a second portion, preferably about 3% of the flow, passing through filter 14 and into cathodic compartment 34 via distribution ring 36.

In one embodiment, splitting the flow of suspension into two portions may be accomplished in a liquid cyclone, not shown. In this instance, the suspension would enter the liquid cyclone and exit as at least two portions. A first portion, rich in solids content, would pass to anodic compartment 32. A second portion, poor in solids content, would enter filter 14 which would be sufficient to filter out particles having a particle size in the range of between about 1 and 5 μm prior to entering cathodic compartment 34 via distribution ring 36. Filtering is sufficiently accomplished by the use of filters equivalent to Whatman ®#5 or Whatman ®#41 analytical filter paper.

Electrolytic cell 16 is divided into anodic compartment 32 and cathodic compartment 34 which are divided by separator 38. To maintain liquid levels as desired, the electrolytic cell 16 is provided with outlet weir 40.

Cathodic compartment 34 contains mandrel assembly, generally 42. Mandrel assembly 42 comprises mandrel 44 attached to mandrel carrier 46 to which rotating cathode 48 with motor drive 50 attaches. Rotating cathode 48 will receive or win the metal in accordance with the invention and may be of nickel or be chrome plated aluminum. Preferably, it is nickel.

Additionally, in accordance with an embodiment of the present invention, oxygen-containing gas supply 52 is provided to cathodic compartment 34 to effect anti-pitting.

Figure 2:
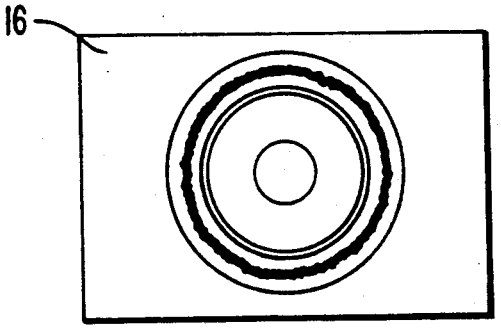
FIG. 2 is a schematic top view of the electrolytic cell shown in FIG. 1.

In the preferred embodiment shown by FIG. 2, anodic compartment 32 surrounds cathodic compartment 34. Anode 54 is preferably comprised of rectangular metal sheets arranged in a cylindrical configuration. More preferably, anode 54 is a cylinder.

In the preferred embodiment shown, anodic compartment 32 is provided with a mixer 56 to maintain the desired flow rate in the compartment and to ensure that the particulates present in the anolyte remain in suspension.

As will be apparent to one skilled in the art, the pH, level and temperature of the liquids of the invention are monitored and controlled by level control 58 and potentiostat 60 in accordance with practices well known in the art.

Anodic and cathodic compartments 32 and 34 are divided by a separator 38 which may be a strong retentive filter media, such as felts used as anode bags in plating. Any conventional separator may be used such as polypropylene felt.

The process of the invention generally takes place as follows: in pre-mix tank 10 an initial charge of electrolyte is made by dissolving particulate waste metal hydroxide in a strong mineral acid. About half of pre-mix tank 10 volume is pumped into sump tank 12 via pump 20, and additional metal hydroxide is dissolved in pre-mix tank 10 repeating the process until sump tank 12, anode compartment 32, cathode compartment 34, and associated plumbing are filled with electrolyte via pump 24, heat exchangers 26 and 28 and filter 14. The pH is maintained at between 3.0 and 4.0) The electrolyte so prepared has a concentration of nickel ions of between 90 and 115 grams per liter. In an embodiment of the invention, particulate waste metal hydroxide is mixed via mixer 18 with electrolyte in premix tank 10 to form a suspension thereof having about 6.5% solids. Electrowinning is begun by applying a current density of about 300 ASF to rotating cathode 48 through conductive shaft 44, conductive support 46 and cathode carrier 42. As metal is electrowon onto rotating cathode 48, acid is generated at anode 54. From pre-mix tank 10, the suspension is transported to sump tank 12 via pump 20 controlled by pH sensor 60 to maintain the desired pH. The suspension is mixed in sump tank 12 by mixer 22 and fed to electrolytic cell 16 via pump 24 and passes through heat exchangers 26 and 28. As previously discussed, prior to entering electrolytic cell 16, the flow of suspension is split at 30. A first portion of the suspension passes directly to anodic compartment 32. Particles of greater than 1 to 5 μm are filtered out of a second portion prior to entering cathodic compartment 34. Because the fine particles are to remain in suspension until they dissolve, a relatively high flow rate is maintained in anodic compartment 32. Mixer 56 is efficient in achieving the desired flow rate in anodic compartment 32.

The particulate waste metal material contains about 20% by weight solids, and about 10% by weight metal, which when dissolved yields a concentration of about 90 to 115 g/L metal ions. A high metal concentration and high cathode current density are necessary to electrowin metal at high plating rates as desired. The suspension is mixed with electrolyte rather than water so that the liquefying agent does not dilute the metal concentration.

In addition to high plating rates, an advantage of electrowinning at a high current density is the attendant reduction in cathode area requirement and therefore a reduction in overall plant size and labor requirements. When the attainment of high current density is desired is it necessary that the current is less than the limiting current density. Also, a minimization of the overall power consumption requirement is desirable. The present invention provides a combination of factors which together accomplish these conditions as will be discussed more fully below.

Preferably, the electrolyte is a solution of a strong mineral acid and a metal hydroxide. More preferably, the strong mineral acid is sulfuric acid or sulfamic acid. Most preferably, the electrolyte is a mixture of sulfuric acid and nickel hydroxide press cake.

In preparing the suspension of the present invention, about 100 grams of metal hydroxide are mixed with about 100 to 300 mL of electrolyte. In a preferred embodiment, 100 grams of nickel hydroxide press cake and 200 mL of electrolyte are added to pre-mix tank 10.

It is preferred in the practice of this invention that the particulates of the suspension do not directly contact rotating cathode 48, or a rough impure plate will result. Accordingly, as previously discussed, a portion of the suspension is filtered by filter 14 and introduced into cathodic compartment 34 through distribution ring 36.

Also advantageous in electrowinning metal at high plating rates is the maintenance of a high cathode surface velocity while maintaining a relatively low flow rate in cathodic compartment 34. Flow velocities at the cathode surface must be sufficient to minimize depletion of metal ions in the cathode film and to neutralize bases generated by the cathode film. The catholyte flow rate is minimized but still sufficient to ensure a slight positive flow outward from cathodic compartment 34 through separator 54 to anodic compartment 32, to replenish plated metal, and to neutralize electrogenerated bases.

To meet the dual requirement of high cathode surface velocity while maintaining low overall catholyte flow, rotating cathode 48 is utilized. In the present invention, surface velocities of the rotating cathode are about 60 to 300 feet per minute. Preferably, cathode surface velocities range between about 60 and 150 feet per minute.

It is common practice to achieve higher cathode surface velocities or higher rate of flow by use of gas, usually air, sparging at a high rate. A disadvantage of this practice is that very fine bubbles at high velocities increase the electrical resistance of the electrolyte, leading to excessive heating and higher electrical usage for a given current density.

Oxygen-containing gas supply 52 in accordance with the present invention is used at a rate much lower than is the common practice in gas sparging and is used as an "anti-pitting" mechanism rather than for cathodic stirring. Pitting is a phenomenon which occurs when the production of hydrogen gas forms at the surface of the electrode and an "electrical shadow" develops. This electrical shadow is commonly referred to as a pit. Metal will not plate out at the pit and this results in roughness in the plating.

By supplying oxygen-containing gas in an upward flow in cathodic compartment 34 at a low rate, the present invention overcomes the above-mentioned disadvantages by saturating the catholyte with an oxygen-containing gas so that the oxygen reacts with nascent hydrogen to form water. Preferably, oxygen-containing gas supply 52 supplies fine bubbles in an upward flow through cathodic compartment 34 at a rate of about 1 to 5 standard liter per minute. The use of oxygen-containing gas supply 52 at rotating cathode 48 permits the formation of a fine dense metal plate while eliminating the need for any added surface tension reducing agents or detergents to the system. This pit-free surface improves the quality of the plate.

In accordance with the invention as previously discussed, the flow rate in anodic compartment 32 is maintained relatively high, while a relatively low flow rate is maintained in cathodic compartment 34.

Specifically, a flow rate of about 0.5–3 gallons per minute is maintained in cathodic compartment 34 and a flow rate of about 15–120 gallons per minute is maintained in anodic compartment 32. More particularly, the flow rate in cathodic compartment 34 is about 1 gallon per minute and the flow rate in anodic compartment 32 is about 30 gallons per minute. The relatively high flow rate is maintained in anodic compartment 32 to ensure that the particulates remain in suspension.

In a preferred embodiment of the present invention, a pH differential is maintained between the catholyte present in cathodic compartment 34 and the anolyte present in anodic compartment 32. The pH of the catholyte is about 3.6–4.0 and the pH of the anolyte is about 2.5–3.7. Preferably, a catholyte pH of about 3.7 and an anolyte pH of about 3.0 is maintained. As the cations (metal ions) are depleted from the catholyte, the pH of the cathyolyte is maintained by the addition of anolyte from anodic compartment 32. The pH of the anolyte may be controlled by addition of the suspension. After processing is complete, it may be necessary to lower the pH of the anolyte before a subsequent start-up of the process. Sulfamic acid may be used to adjust the pH. Advantageously, sulfamic acid prevents the evolution of chlorine gas from chlorides present in electrolytic cell 16.

As discussed previously, anodic and cathodic compartments 32 and 34 are separated by separator 54 which is a strong retentive filter media, such as felts used as anode bags in plating. Any conventional separator may be used such as polypropylene felt. Free flow of electrolyte and particulates are restrained by the fine pore separator, while cations are selectively driven by the electrode potential difference from anodic compartment 32 to cathodic compartment 34, and anions are driven by electrode potential from cathodic compartment 34 to anodic compartment 32. The transferred metal ions plate out onto rotating cathode 48 while the transferred sulfate ions form sulfuric acid at the anode 54. Thus, this physical separation tends to cause an increase in pH in cathodic compartment 34 and a decrease in pH in anodic compartment 32. The pH may be adjusted as previously discussed.

The electrodes used in the present invention are preferably dimensionally stable. If the electrodes are corrodible, then they should not contribute nickel or foreign ions to the electrolyte bath. Rotating cathode 48 is nickel or chrome plated aluminum. Preferably, the cathode is nickel. Anode 54 may be made of platinum, lead or carbon. Preferably, the inert anode is made of a metal sheet formed into a cylinder.

Electrolyte level in electrolytic cell 16 is maintained by an outlet means such as outlet weir 40 and by potentiostat 60 in sump tank 12. Fluid flow through the heat exchangers 26 and 28, and filter 14 is maintained by pump 24 at a total flow of between 15 and 60 gallons per minute.

A temperature of about 60° C. is preferred for electrowinning of metal. Because both resistive heating (IR drop between anode and cathode) and evaporative cooling is taking place, it is preferable to include heat exchangers 26 and 28 after pump 24. Total liquid volume is increased by addition of suspension, deionized water (via level control 58), and outlet weir 40 and is decreased by evaporation from the liquid surfaces. For this reason, it is preferable to include level control 58 and potentiostat 60 to maintain liquid volume automatically in sump tank 12.

Preferably, small bleed 62 of spent electrolyte is maintained to prevent build up of non-platable ions such as sodium and boric acid in the electrolyte. Sulfuric acid may be added to cathodic compartment 34 to compensate for loss of sulfate ions in the bleeding of the electrolyte. In a preferred embodiment of the invention, the particulate waste metal material is nickel hydroxide press cake.

The following working Example is provided to illustrate the present invention and some of its advantages. The Example is in no way limitative of the present invention.

EXAMPLE 1

Initial Preparation of Electrolyte for Electrowinning from Nickel Hydroxide Press Cake Into a 4L beaker, 506 g of nickel hydroxide press cake was introduced. 20 mL of concentrated sulfuric acid was dropwise added while stirring until a solution formed. Then, 560 g of press cake was added and dispersed with a hand held mixer. 20 mL of $H_2SO_4$ were added while stirring about two minutes. The pH was measured. If less than 3.0, subsequent additions of sulfuric acid were reduced, and if greater than 3.5, subsequent additions of sulfuric acid were increased. 1100 g of press cake were added and dispersed into the electrolyte with a Braun ® mixer. 40 mL of $H_2SO_4$ were added while stirring for about four minutes. Additional press cake and sulfuric acid were added while stirring as above to form 3L of electrolyte. About 2L of the eletrolyte were then transferred to the electrolytic cell. The previous steps were repeated until a desired amount of electrolyte was produced.

EXAMPLE 2

Preparation of Suspension 100 grams of press cake for each hour running time were added to the pre-mix tank and mixed with 200 mL of electrolyte which were taken from the electrolytic cell to form a pre-mix. The pre-mix was then pumped to the sump tank which contained additional electrolyte and stirred to form a nickel hydroxide suspension.

EXAMPLE 3

Electrowinning of Nickel from Nickel Hydroxide Suspension

Preparation of the rotating cathode: A 3.25 inch diameter by 5.5 inch nickel sleeve is used as the rotating cathode. The areas not to be plated were "stopped off," including the interior of the cylinder with commercial plating "stop off" dope and Plater's tape. After the "stop-off" was dry, the cathode assembly was weighed and then lowered into the cathodic compartment.

Electrowinning: The heating exchanger, air supply and recirculating pumps were started. When a temperature of at least 60° C. was reached, the pH of the anolyte was adjusted to about 3.5 by adding either sulfamic acid ($HSO_3N_2$) powder or press cake suspension or slurry. The current was then slowly adjusted to 10 amperes by steps of 1 ampere every 10 seconds. Accurate records of time and current were kept to calculate efficiency. The anolyte pH was maintained at 3.5+/−0.1 by adding with an automatic potentiostat increments of the nickel hydroxide press cake suspension. The pH and volumes of addition were recorded, and periodically samples of the anolyte and catholyte solutions were taken for analysis.

Plate evaluation: The power was shut down and the cathode assembly removed. The cathode was then thoroughly washed with deionized water and dried at low temperature and re-weighed. By difference, the weight of nickel plated, and the ampere-hours plated could be obtained. The efficiency could then be calculated. Additionally, the theoretical amount of nickel plated could be obtained by multiplying the amp-hrs by 1.106. % Efficiency=(act wt Ni++) / (calc wt Ni++)×100

Analysis of the solutions may be performed to evaluate the rate of build up in non-platables, such as boric acid, chlorides and sodium, and decline in nickel concentration.

Nickel concentration is analyzed on a 2.0 mL aliquot which adjusted to a pH of 10 su with 4% aqueous ammonia and then titrated with 0.05 molar ethylene diamine tetraacetic acid (EDTA) to the color change of a Murexide indicator from red to bright purple. Each mL of 0.05 M EDTA represents 2.94 g/L nickel ions in the original solution.

Boric acid is measured on a 2.0 mL aliquot which is adjusted to a pH 4.0 su with 0.05N sodium hydroxide (NaOH), then dosed with mannatol (which liberates hydrogen ions) and then titrated to a pH of 4.0 su with 0.1N sodium hydroxide. Each mL of 0.1N NaOH represents 0.618 g/L of boric acid in the original solution.

Chloride ions are measured on a 2.0 mL aliquot which is acidified with 50 mL of 0.005N nitric acid ($HNO_3$) using a silver billet electrode with a double junction Ag/AgCl reference electrode (with sodium nitrate ($NaNO_3$) in the outer junction) to the electropotential inflection. Each mL of 0.1N $AgNO_3$ represents 3.545 g/L of chloride ions in the original solution.

Sodium and other trace level cations are determined by atomizing the solution into the plasma torch of an Inductively Coupled Plasma Spectrometer (ICP) and comparing the intensity of the signal at each characteristic wavelength to the intensity produced by known standard solutions aspirated into the same instrument under the same conditions. Other methods known to those practiced in the art of analytical polarography and colorimetric reaction may be used.

The following is a description of an operation to be conducted in the pilot plant as shown in FIG. 1.

EXAMPLE 4

An initial charge of electrolyte is prepared by dissolving a metal hydroxide press cake in pre-mix tank 10, and transferring the electrolyte to the electrowinning module. Since pre-mix tank 10 is much smaller than the electowinning module, many repeated operations are required. This repetition is required only at initial start up, and not again required unless the module is taken down for major service or repair.

The electrolyte is a solution and is made up of 50 gallons (about 450 pounds) of the metal hydroxide liquefied with about 8 pounds of 1.84 sp. gr. sulfuric acid. Since the hydroxide press cake is a solid, even though it contains about 80% water, after the initial 100 gallons of electrolyte are made, each subsequent 50 gallons are made by first slurring the solids in 100 gallons of existing electrolyte, then adding (slowly) about 8 pounds of sulfuric acid. The pH is controlled in this process; if it rises above about 3.0, more acid is used; if it falls below 3.0, less acid is used.

About 100 gallons of the electrolyte prepared above (or taken from the electrowinning module in subsequent start ups) is mixed with about 450 pounds of the metal hydroxide press cake in pre-mix tank 10. The resulting suspension is the feed for the electrowinning process.

Electrowinning is begun, which generates acid at the anode and deposits metal on the cathode. The rapid circulation through the system quickly disperses the generated acid throughout the anode electrolyte and sump tank 12. The pH potentiostat 60 in sump tank 12 calls for the addition of slurry from tank 10 via pump 20 to adjust the pH and maintain the pH set point. While on initial addition a dilute suspension is formed and distributed throughout the system by main pump 24, except for the cathode volume which is filtered. The fine particles in the suspension quickly dissolve. Because it is imperative to keep the fine particles in suspension until they dissolve, mixers 56 and 22 are provided.

It will be apparent to those skilled in the art that various modifications and variations can be made in the equipment and overall process described hereinabove without departing from the scope or spirit of the present invention.

What is claimed is:

1. An apparatus for electrowinning a metal from a waste metal material, comprising:

(a) a vessel including means for mixing said waste metal material with an electrolyte to form a suspension;

(b) an electrolytic cell in fluid connection with said vessel, said electrolytic cell comprising:

(i) a cathodic compartment having a rotating cathode;

(ii) an anodic compartment adjacent to said cathodic compartment; and (iii) a means for separating disposed between said cathodic and anodic compartment;

(c) means for moving a flow of said suspension from said vessel to said electrolytic cell; and (d) a filter means located between said vessel and said electrolytic cell.

2. The apparatus according to claim 1, wherein said means for moving comprises:

means for splitting the flow into a first portion and a second portion;

means for passing said first portion to said anodic compartment; and means for passing said second portion through said filter means and to said cathodic compartment.

3. The apparatus according to claim 1, further comprising a means for supplying an oxygen-containing gas in an upward flow in said cathodic compartment.

4. The apparatus according to claim 1, wherein said electrolytic cell further comprises an outlet means for returning overflow electrolyte from said electrolytic cell to said vessel.

5. The apparatus according to claim 1, wherein said vessel comprises means for mixing said waste metal material with an electrolyte to form a pre-mix thereof and a means for mixing said pre-mix with additional electrolyte to form said suspension.

6. The apparatus according to claim 1, wherein said anodic compartment further comprises a mixing means.

7. The apparatus according to claim 1, wherein said anodic compartment surrounds the cathodic compartment.

8. The apparatus according to claim 1, wherein said separating means comprises polypropylene felt.

9. The apparatus of claim 1, wherein said rotating cathode comprises nickel or comprises chrome plated aluminum.

* * * * *